US005533087A

United States Patent [19]

Snoeren

[11] Patent Number: 5,533,087

[45] Date of Patent: Jul. 2, 1996

[54] X-RAY IMAGING SYSTEM INCLUDING BRIGHTNESS CONTROL

[75] Inventor: Rudolph M. Snoeren, Eindhoven, Netherlands

[73] Assignee: U.S. Philips Corporation, New York, N.Y.

[21] Appl. No.: 314,037

[22] Filed: Sep. 28, 1994

Related U.S. Application Data

[63] Continuation of Ser. No. 993,341, Dec. 18, 1992.

[30] Foreign Application Priority Data

Dec. 19, 1991 [EP] European Pat. Off. ..... 91203356

[51] Int. Cl.[6] ..... H05G 1/64

[52] U.S. Cl. ..... 378/98.3; 378/98.2; 378/98.7

[58] Field of Search ..... 378/99, 98.3, 98.7

[56] References Cited

U.S. PATENT DOCUMENTS 4,210,812 7/1980 Ando et al. ..... 250/416
4,472,826 9/1984 van de Ven ..... 378/99
4,857,724 8/1989 Snoeren ..... 250/213 VT
4,872,747 10/1989 Jalkio et al. ..... 350/421
5,177,777 1/1993 Niino ..... 378/99

FOREIGN PATENT DOCUMENTS 0087843 of 0000 European Pat. Off. .

*Primary Examiner*—Craig E. Church
*Attorney, Agent, or Firm*—Jack D. Slobod

[57] ABSTRACT

X-ray imaging system is arranged such that the exit screen of the X-ray image intensifier can be imaged, via a beam deflection element, on a pick-up device (CCD sensor) and on a photodiode for automatic dose control or exposure timing. Because the beam deflection element (prism, partly transparent cube or mirror) covers the entire cross-section of the exit screen, a uniformly illuminated exit screen is imaged on the pick-up device as a uniformly illuminated surface. When the pick-up device is arranged transversely of the prolongation of the X-ray image intensifier and the photodiode is arranged in the prolongation of the X-ray image intensifier, a compact system is obtained. When use is made of an anamorphic system comprising two prisms, a part of the light beam can be reflected to the photodiode from a surface of a prism. More accurate exposure timing can be achieved by measurement of the light reflected by the CCD sensors.

12 Claims, 1 Drawing Sheet

X-RAY IMAGING SYSTEM INCLUDING BRIGHTNESS CONTROL

This is a continuation of application Ser. No. 07/993,341, filed Dec. 18, 1992.

BACKGROUND OF THE INVENTION

1. Field of the Invention

The invention relates to an X-ray imaging system, including an X-ray source for emitting an X-ray beam capable of forming an X-ray image after irradiation of an object to be arranged within the X-ray beam, an X-ray detector for converting the X-ray image into an optical image on an exit screen, a control unit for controlling the X-ray source, and a light-optical imaging system for imaging the exit screen on an entrance screen of an image pick-up device, said light-optical imaging system being configured for deflecting a portion of the light emanating from the exit screen toward a photosensitive sensor for forming a control signal to be applied to the control unit. The invention also relates to imaging means suitable for use in such an X-ray imaging system.

2. Description of the Related Art

An X-ray imaging system of the kind set forth is known from European Patent Specification EP 087 843 which corresponds to commonly owned U.S. Pat. No. 4,472,826.

The cited Patent Specification describes an X-ray imaging system in which imaging means are arranged behind the exit screen of an X-ray image intensifier tube and comprise a tandem optical system comprising two lenses, the exit screen being situated in the focal plane of one lens whereas the entrance screen of the image pick-up device, for example comprising a television pick-up tube or a CCD sensor, is situated in the focal plane of the second lens. Between the lenses there is arranged a semitransparent mirror whereby a part of the light beam emanating from the exit screen is projected onto a photographic film of a 100 mm photocamera or onto a 35 mm film of a film camera. Between the lenses of the tandem optical system there is arranged a beam deflection element in the form of a prism whereby a part of the light beam is deflected from the main beam so as to be imaged onto a measurement field selector via a lens. Behind the measurement field selector there is arranged a photosensitive sensor, for example a photodiode, which converts the luminous flux transmitted by the measurement field selective diaphragm into an electric current. The entire exit screen of the X-ray image intensifier tube can be imaged onto the measurement field selector, situated outside the light beam, by mirroring a part of the light beam present between the lenses. The measurement field selector serves to measure the brightness of selected parts of the exit screen of the X-ray image intensifier tube so as to increase or decrease, via a control unit connected to the X-ray source, the voltage or current of the X-ray source when the measured brightness deviates from a desired value. For example, when use is made of a cine film with a film frequency of 50 images per second, the brightness of the exit screen is higher for suitable exposure of the film than in the case of, for example spot film exposures with a film frequency of up to, for example 8 images per second. The image frequencies are dependent on the speed of motion of the objects to be imaged (for example, heart, lungs or vessels). Also in the absence of a photocamera or film camera, a predetermined, constant brightness of the exit screen of the X-ray image intensifier tube is required during irradiation of patients of different thickness in order to ensure adequate illumination of the television pick-up device. When a part of the light beam emanating from the exit screen is deflected and at least a part of this beam is detected, a control signal is formed whereby the voltage and the current of the X-ray source are adjusted via the control unit.

The control signal obtained by mirroring a part of the light beam emanating from the exit screen also serves for exposure timing. Integration of a part of the luminous flux emanating from the exit screen produces a measure for the exposure of the film or the image pick-up device. When the exposure is sufficient, the X-ray source is switched off via the control signal which is formed, for example by an integrated photodiode current.

The known prism for deflecting a part of the light beam emanating from the exit screen has the drawback that it is liable to produce a visible spot in the image. Another drawback consists in that the dimensions and the complexity of the imaging means are increased by the presence of an additional component between the exit screen of the X-ray image intensifier and the television pick-up device.

SUMMARY OF THE INVENTION

It is inter alia an object of the invention to provide an X-ray imaging system in which a control signal can be formed without disturbing the imaging process. It is also an object of the invention to provide an X-ray imaging system comprising compact imaging means. It is a further object of the invention to provide imaging means enabling accurate formation of a control signal.

To achieve this, an X-ray imaging system in accordance with the invention is characterized in that the reflection surface is partly transparent and covers the entire cross-section of the light beam emanating from the exit screen.

By mirroring a part of the light beam emanating from the exit screen across the entire surface of the exit screen, mirroring locally induces a uniform attenuation. Thus, in the case of an exit screen of uniform brightness, an image of uniform brightness is also obtained on the entrance screen of the image pick-up device.

An embodiment of an X-ray imaging system in accordance with the invention is characterized in that the exit screen is imaged onto the entrance screen of the image pick-up device via the reflection surface.

The image pick-up device may be arranged in the prolongation of the X-ray image intensifier tube, the light transmitted by the beam deflection device then being incident on the entrance screen of the image pick-up device. A more compact construction of an X-ray imaging system is obtained when the image pick-up device is arranged transversely of the prolongation of the X-ray image intensifier tube. Notably when a television pick-up tube is used as the image pick-up device, a compact construction is obtained by arranging the television pick-up tube in the described manner.

A further embodiment of an X-ray imaging system in accordance with the invention is characterized in that the reflection surface comprises a surface of an anamorphic optical system.

When use is made of an anamorphic optical system between the exit screen of the X-ray image intensifier tube and the entrance screen of the image pick-up device, as described in European Patent Application EP 295 728-A1 which corresponds to U.S. Pat. No. 4,857,724, image compression of the round exit screen can be achieved. When the round exit screen is imaged as an ellipse on an image pick-up device comprising a rectangular entrance screen, notably a CCD sensor, the horizontal resolution of the sensor is enhanced. When the CCD sensor is read out and the image detected by the CCD sensor is displayed on a television monitor, the image compression is cancelled by adaptation of the read-out frequency of the shift register of the sensor. When use is made of an anamorphic optical system which may comprise a cylinder lens or a fibre optical system, it is not possible to use a tandem optical system as in the known imaging means. When use is made of the reflective properties of the anamorphic optical system, a part of the light beam can be mirrored over the entire cross-section of the light beam emanating from the exit screen of the X-ray image intensifier tube, without using an additional prism. Thus, compact imaging means can be realised in which imaging is not disturbed by the formation of the control signal.

A preferred embodiment of an X-ray imaging system in accordance with the invention is characterized in that the anamorphic optical system comprises a system of prisms.

When a system of prisms is used, for example, approximately 5% of the luminous flux can be deflected from the beam to the photodiode by reflection from the prism situated nearest to the exit screen of the X-ray image intensifier tube. To this end, a customarily used anti-reflection coating of, for example $MgF_2$ can be omitted or removed from the side of the prism facing the exit screen.

An embodiment of an X-ray imaging system in accordance with the invention is characterized in that the photosensitive sensor is arranged in a path of light reflected from the entrance screen of the image pick-up device.

By using a part of the light beam reflected from the entrance screen of the image pick-up device, a measure is obtained for the luminous intensity actually occurring at the area of the entrance screen of the image pick-up device. Because not all light emanating from the exit screen of the X-ray image intensifier tube reaches the image pick-up device, due to an adjustment of the diaphragm, more accurate exposure timing is achieved by means of the control signal formed on the basis of the light beam reflected from the entrance screen.

A further embodiment of an X-ray imaging system is characterized in that, via a beam deflection element, the exit screen is imaged on entrance screens of two or more image pick-up devices.

The light beam emanating from the exit screen is partly transmitted by the beam deflection element to the first image pick-up device and is partly deflected to the second image pick-up device. By using two image pick-up devices which have been mutually shifted relative to the image of the exit screen, the resolution can be doubled in the direction of shift. The light reflected by the entrance screen of the first image pick-up device is partly deflected to the photodiode by the beam deflection element and the light of the second image pick-up device is partly transmitted to the photodiode. The beam deflection element may comprise a semi-transparent mirror or an optical splitting cube.

BRIEF DESCRIPTION OF THE DRAWING

Some embodiments of an X-ray imaging system in accordance with the invention will be described in detail hereinafter with reference to the accompanying drawing. Therein.

DETAILED DESCRIPTION OF THE PREFERRED EMBODIMENT

Figure 1:
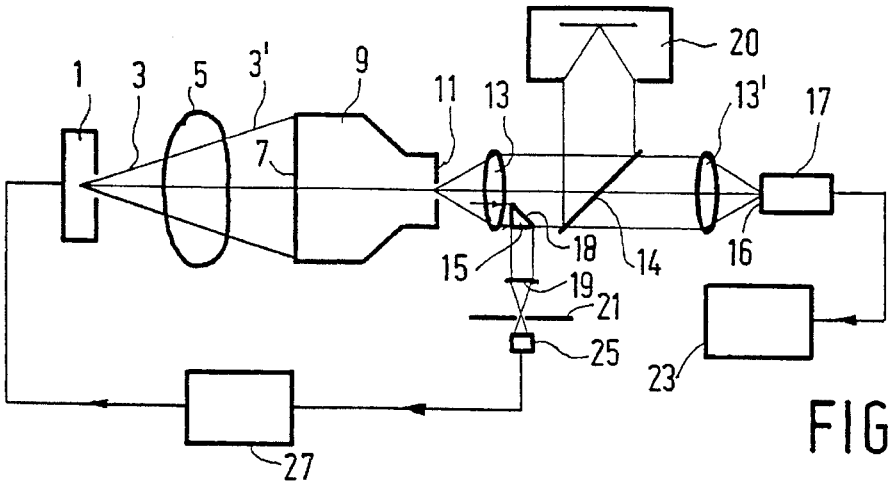
FIG. 1 shows a known X-ray imaging system.

FIG. 1 shows an X-ray imaging system, comprising an X-ray source 1 which emits an X-ray beam 3. An object 5, notably a part of a patient arranged in the X-ray beam 3, attenuates the X-ray beam in dependence on the local absorption density within the patient. An image-carrying X-ray beam 3' is incident on an entrance screen 7 of an X-ray detector 9, notably an X-ray image intensifier tube. The entrance screen 7 comprises a scintillation layer of CsI in which the X-rays release light which releases electrons in a photocathode. The electrons are accelerated to, for example 20 keV by means of an electron-optical system (not shown in the Figure) so as to be focused onto an exit screen 11 of the X-ray image intensifier tube 9. A brightness-intensified optical image of the X-ray image detected on the entrance screen 7 of the X-ray image intensifier tube then appears on the round exit screen 11 which comprises a phosphor layer. Via imaging means, comprising a tandem optical system 13—13', a partly transparent mirror 14 and a beam deflection element in the form of a prism 15, the exit screen 11 is imaged on the entrance screen 16 of an image pick-up device 17, notably a CCD sensor, on a measurement field selecting diaphragm 21 and on the film of a photo or film camera 20. The video signal generated by the CCD sensor 17 is applied to a television monitor 23. A part of the light beam present between the lenses 13 is mirrored out via a reflection surface 18 of the prism 15 which is arranged between the lenses 13. Via a lens 19, the exit screen 11 of the X-ray image intensifier tube 9 is imaged on the diaphragm 21. The part of the exit screen 11 selected by the diaphragm 21 activates a photosensitive sensor 25, notably a photodiode, which forms an electric control signal which is applied to a control unit 27. The control unit 27 is connected to the X-ray source 1 and is capable of adapting, in dependence on the control signal, the voltage (kV) and the current (mA) in the X-ray source 1 in order to achieve constant brightness on the exit screen 11 (automatic dose control) in the case of patients 5 of different thickness. For exposure timing, the control unit can also deactivate the X-ray source when the integrated control signal has reached a predetermined value which is sufficient to ensure suitable exposure of the CCD sensor 17 or the film of the camera 20.

Figure 2:
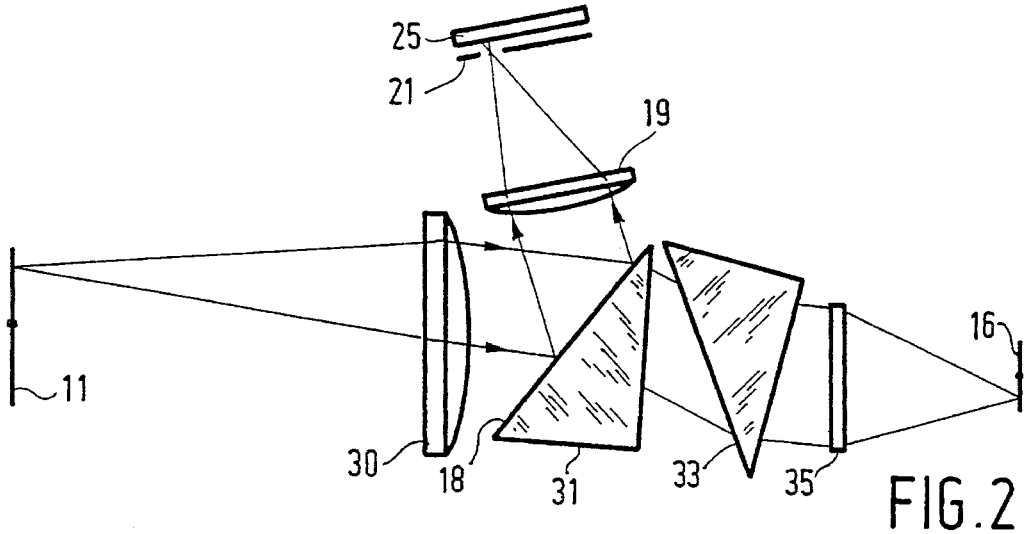
FIG. 2 shows imaging means in accordance with the invention.

FIG. 2 shows the imaging means in accordance with the invention, comprising a collimator lens 30, an anamorphic optical system comprising two prisms 31 and 33, a camera lens 35, and the lens 19. Via the imaging means, the circular exit screen 11 of the X-ray image intensifier tube 9 is imaged as an ellipse on the entrance screen 16 of the CCD sensor 17 as described in the aforementioned U.S. Pat. No. 4,857,724 which is incorporated herein by reference. The horizontal resolution of the CCD sensor can thus be increased or the part of the image sensor used in the vertical direction can be adapted to the number of image lines of the television monitor 23. This is disclosed in commonly owned U.S. patent application Ser. No. 07/738,394, filed Jul. 31, 1991. Via the reflection surface 18 of the prism 31, a part of the exit pupil of the lens 30 can be reflected to the lens 19, the exit surface being imaged on the measurement field selecting diaphragm 21. When the customary $MgF_2$ anti-reflective coating on the surface 18 of the prism 31 is omitted, the prism also constitutes the beam deflection element whereby a reflection of 5% or more can be achieved.

Figure 3:
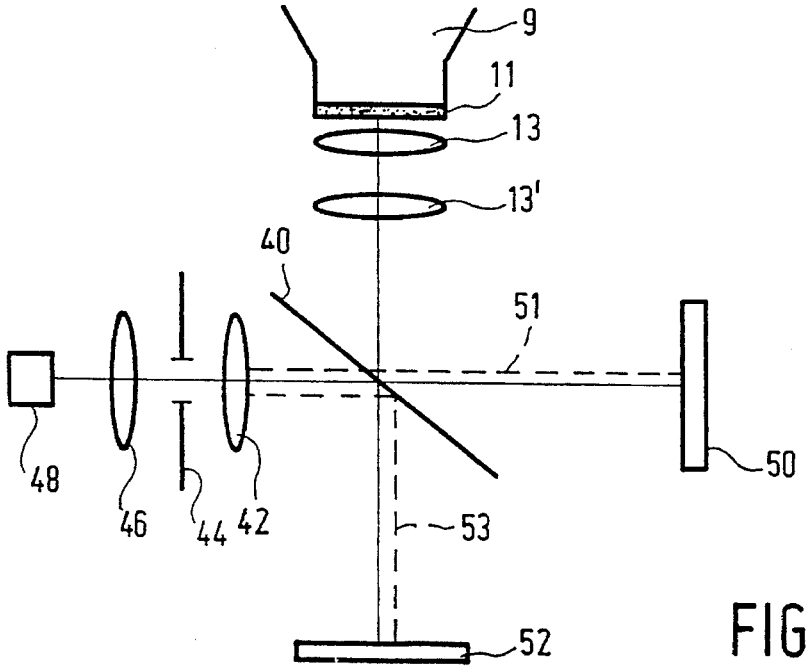
FIG. 3 shows imaging means in which an entrance screen of an image pick-up device acts as a reflection surface.

FIG. 3 shows an embodiment of an X-ray examination system in which the beam deflection element comprises a partly transparent mirror or prism 40. Via the mirror 40, an image of an exit screen 11 is projected onto a laterally arranged CCD sensor 50. Light transmitted by the partly transparent mirror is projected onto a further CCD sensor 52. Both sensors partly reflect the incident light. As has already been stated, the degree of reflection can be adapted. The reflected image-carrying light beams 51 and 53 of the two sensors are imaged by a lens 42, via the partly transparent mirror, on a measurement field determining diaphragm 44 and the light transmitted thereby is focused, via a field lens 46, on a photosensor 48 which may be constructed as a single sensor, a television pick-up tube, a CCD matrix etc. The photosensor thus generates a signal which is a measure for the brightness of a measurement field within the image or, if desired, of the entire image. The variables determining the brightness can be controlled in known manner by means of this signal. In an arrangement of this kind, brightness control utilizes only light which otherwise would be lost and no light selection element which readily disturbs the imaging need be arranged in the image-carrying light beam. The second lens 13', also referred to as the camera lens, of the tandem lens system 13, 13' in a practical embodiment forms part of the camera, the first lens forming more or less part of the imaging system comprising the image intensifier 9. The first lens 13, also referred to as the collimator lens, may then also form part of the exit window 11 of the tube 9.

I claim:

1. An X-ray imaging system, comprising:

an X-ray source for emitting an X-ray beam capable of forming an X-ray image after irradiation of an object to be arranged within the X-ray beam, an X-ray detector for converting the X-ray image into an optical image on an exit screen, a control unit for controlling the X-ray source, image conversion means for converting said optical image into an electronic image, said image conversion means including an image conversion element having an input optical surface, said input optical surface having a primary function of transmitting incident image light received from said exit screen into said image conversion element for image conversion thereof and having an incidental function of reflecting a portion of said incident image light, and means for directing said portion of said incident image light reflected by said input optical surface onto a photosensitive sensor connected to said control unit for supplying a sensed signal to said control unit.

2. An X-ray imaging system as claimed in claim 1, wherein said image conversion means includes an anamorphic optical system for modifying an aspect ratio of the optical image and an image pick-up device for converting a resulting modified optical image having a modified aspect ratio into an electronic image, said image conversion element being an anamorphic optical element.

3. An X-ray imaging system as claimed in claim 2, wherein the anamorphic optical system comprises a system of prisms, one of which is said image conversion element.

4. An X-ray imaging system as claimed in claim 1, wherein said image conversion means includes an image pickup device for converting the optical image into an electronic image, said image conversion element being an entrance screen of said image pick-up device.

5. An X-ray imaging system as claimed in claim 4, wherein said image conversion means includes a further image pick-up device for converting the optical image into a further electronic image, said image conversion element further including an entrance screen of said further image pick-up device.

6. An X-ray imaging system as claimed in claim 4, wherein said means for directing includes a beam-splitting device.

7. An X-ray imaging system comprising:

an X-ray source for irradiating an object with an X-ray beam to form an image-carrying X-ray beam;

a control unit for controlling the X-ray source;

an X-ray detector for converting the X-ray image into an optical image on an exit screen (11);

a photosensor (25) for deriving a control signal from the optical image and for supplying the control signal to the control unit for controlling the X-ray source; and light-optical imaging means (30, 31, 33, 35) for imaging the optical image on the exit screen (11), via a partly transparent reflection surface covering the entire cross-section of the image carrying light-beam emanating from the exit screen onto an entrance lens (16) of an image pick-up device and by reflection on the reflection surface onto the photosensor (25), characterized in that the light-optical imaging means comprises an anamorphic optical system (31, 33), wherein the reflection surface in formed by a surface of the anamorphic optical system.

8. An X-ray imaging system as claimed in claim 7, characterized in that the anamorphic optical system comprises a system of prisms (31, 33).

9. An X-ray imaging system comprising:

an X-ray source for irradiating an object with an X-ray beam to form an image-carrying X-ray beam;

a control unit for controlling the X-ray source;

an X-ray detector for converting the X-ray image into an optical image on an exit screen (11);

a photosensor (25) for deriving a control signal from the optical image and for supplying the control signal to the control unit for controlling the X-ray source; and light-optical imaging means (13, 13', 40) comprising a beam deflection (40) element, for imaging the optical image on the exit screen (11), via a partly transparent reflection surface of the beam deflection element (40) onto the entrance lens of an image pick-up device (50, 52) and onto the photosensor (48), wherein the reflection surface covers the entire cross section of the image-carrying light-beam emanating from the exit screen, characterized in that the photosensor (48) is arranged so that light emanating from the exit screen (11) reaches the photosensor substantially only via reflection from the entrance lens of the image pick-up device (50, 52).

10. An X-ray imaging system as claimed in claim 9, characterized in that the exit screen is imaged on entrance lenses of two or more image pick-up devices (50, 52) via the beam deflection element (40).

11. An X-ray imaging system as claimed in claim 10, characterized in that the light reflected by the entrance lenses of the image-pick up devices (50, 52) is projected on the photosensor (48) via the beam deflection element (40).

12. An X-ray imaging system as claimed in claim 11, characterized in that light reflected by the entrance lenses of the image pick-up devices is imaged onto a diaphragm (44) determining a measurement field by a lens (42).

* * * * *